US009068802B2

(12) United States Patent
Citterio et al.

(10) Patent No.: US 9,068,802 B2
(45) Date of Patent: Jun. 30, 2015

(54) MULTI-LAYER STRUCTURE FOR BALLISTIC PROTECTION

(75) Inventors: Filippo Citterio, Monza (IT); Giorgio Celeste Citterio, Monza (IT)

(73) Assignee: F.LLI CITTERIO, Monza (IT)

( * ) Notice: Subject to any disclaimer, the term of this patent is extended or adjusted under 35 U.S.C. 154(b) by 0 days.

(21) Appl. No.: 14/238,337

(22) PCT Filed: Aug. 11, 2011

(86) PCT No.: PCT/IT2011/000295
§ 371 (c)(1),
(2), (4) Date: Mar. 24, 2014

(87) PCT Pub. No.: WO2013/021401
PCT Pub. Date: Feb. 14, 2013

(65) Prior Publication Data

US 2014/0290474 A1 Oct. 2, 2014

(51) Int. Cl.
*F41H 5/02* (2006.01)
*F41H 5/04* (2006.01)

(52) U.S. Cl.
CPC ..... *F41H 5/0478* (2013.01); *F41H 5/0428* (2013.01); *F41H 5/0457* (2013.01); *F41H 5/04* (2013.01); *F41H 5/0414* (2013.01); *F41H 5/0442* (2013.01); *F41H 5/0471* (2013.01)

(58) Field of Classification Search
USPC ..... 89/36.02, 36.05, 901–917; 428/911; 109/49.5
See application file for complete search history.

(56) References Cited

U.S. PATENT DOCUMENTS

| | | | | |
|---|---|---|---|---|
| 3,722,355 | A | | 3/1973 | King |
| 4,475,247 | A | * | 10/1984 | Lee ..... 2/2.5 |
| 4,613,535 | A | | 9/1986 | Harpell et al. |
| 4,774,724 | A | * | 10/1988 | Sacks ..... 2/2.5 |
| 4,836,084 | A | * | 6/1989 | Vogelesang et al. ..... 89/36.02 |

(Continued)

FOREIGN PATENT DOCUMENTS

| | | |
|---|---|---|
| GB | 2258389 | 2/1993 |
| IT | MI2009A001222 | 7/2009 |

(Continued)

OTHER PUBLICATIONS

1-Non-Final Office Action for U.S. Appl. No. 12/575,271, filed Oct. 7, 2009 in the name of Giorgio Citterio et al. date issued: Feb. 26, 2013.

(Continued)

*Primary Examiner* — Samir Abdosh
(74) *Attorney, Agent, or Firm* — Steinfl & Bruno LLP

(57) ABSTRACT

A ballistic protection is described. The ballistic protection includes a rigid structure and a flexible structure, co-operating to dissipate energy associated to an incident bullet impact, the rigid structure and the flexible structure being separated by at least a first discontinuity layer. The rigid structure includes at least a first rigid layer, at least a second rigid layer, and at least a third layer interposed between the first and the second rigid layer. The material of the first discontinuity layer and of the third layer of the rigid structure are selected so that a speed of propagation of a sound wave through the first discontinuity layer and the third layer of the rigid structure is less than 50% of the speed of propagation of a sound wave through fibers of the first rigid layer. The third layer can have a frame shape extending along the edges of the ballistic rigid protections, so that protection is increased along the borders.

17 Claims, 2 Drawing Sheets

(56) References Cited

U.S. PATENT DOCUMENTS

| | | | | |
|---|---|---|---|---|
| 4,989,266 | A | 2/1991 | Borgese et al. | |
| 5,344,687 | A * | 9/1994 | Grimnes | 428/102 |
| 5,529,826 | A * | 6/1996 | Tailor et al. | 428/110 |
| 5,621,914 | A | 4/1997 | Ramone et al. | |
| 6,000,055 | A * | 12/1999 | Citterio | 2/2.5 |
| 6,276,254 | B1 | 8/2001 | Cordova et al. | |
| 6,893,704 | B1 | 5/2005 | Van der Loo | |
| 7,255,035 | B2 * | 8/2007 | Mowers | 89/41.05 |
| 7,799,710 | B1 | 9/2010 | Tan | |
| 8,297,601 | B2 | 10/2012 | Vito et al. | |
| 2004/0161989 | A1 | 8/2004 | Dennis et al. | |
| 2009/0142557 | A1 | 6/2009 | Hardin | |
| 2010/0297388 | A1 | 11/2010 | Dagher et al. | |
| 2011/0008592 | A1 | 1/2011 | Citterio et al. | |
| 2011/0048220 | A1 | 3/2011 | Dickson | |
| 2012/0174748 | A1 * | 7/2012 | Landi | 89/36.02 |
| 2014/0137726 | A1 * | 5/2014 | Wagner et al. | 89/36.02 |

FOREIGN PATENT DOCUMENTS

| | | |
|---|---|---|
| WO | 91/00490 | 1/1991 |
| WO | 2004/074761 | 9/2004 |
| WO | 2005/065029 | 7/2005 |
| WO | 2007/115057 | 3/2007 |

OTHER PUBLICATIONS

2-Final Office Action for U.S. Appl. No. 12/575,271, filed Oct. 7, 2009 in the name of Giorgio Citterio et al. date issued: Aug. 13, 2014.

3-Advisory Action for U.S. Appl. No. 12/575,271, filed Oct. 7, 2009 in the name of Giorgio Citterio et al. date issued: Oct. 21, 2014.

PCT International Search Report mailed on May 23, 2012 for PCT/IT2011/000295 filed on Aug. 11, 2011 in the name of F.Lli Citterio et al.

PCT Written Opinion mailed on May 23, 2012 for PCT/IT2011/000295 filed on Aug. 11, 2011 in the name of F.Lli Citterio et al.

Italian Search Opinion completed on Mar. 4, 2010 for Italian application MI2009A001222 filed on Jul. 9, 2009 Giorgio Citterio, et al.

Italian Search Report completed on Mar. 4, 2010 for Italian application MI2009A001222 filed on Jul. 9, 2009 Giorgio Citterio, et al.

Italian Search Opinion completed on Mar. 4, 2010 for Italian Patent Application MI2009A001223 filed on Jul. 9, 2009 in the name of F. Lli Citterio SPA.

Italian Search Report completed on Mar. 4, 2010 for Italian Patent Application MI2009A001223 filed on Jul. 9, 2009 in the name of F. Lli Citterio SPA.

Non-Final Office Action mailed on Apr. 2, 2012 for U.S. Appl. No. 12/575,301, filed Oct. 7, 2009 in the name of Giorgio Citterio.

Final Office Action mailed on Jul. 6, 2012 for U.S. Appl. No. 12/575,301, filed Oct. 7, 2009 in the name of Giorgio Citterio.

Non-Final Office Action mailed on Dec. 27, 2013 for U.S. Appl. No. 12/575,271, filed Oct. 7, 2009 in the name of Giorgio Citterio.

Final Office Action mailed on Jul. 15, 2013 for U.S. Appl. No. 12/575,271, filed Oct. 7, 2009 in the name of Giorgio Citterio.

Non-Final Office Action mailed on Aug. 29, 2012 for U.S. Appl. No. 12/575,271, filed Oct. 7, 2009 in the name of Giorgio Citterio.

Definition of "adhere" from Merriam-Webster online dictionary retrieved on Jul. 11, 2013 from http://www.merriam-webster.com/dictionary/adhered.

Definition of "glue" from Merriam-Webster online dictionary retrieved on Jul. 11, 2013 from http://www.merriam-webster.com/dictionary/glued.

Huang, Y.K., et al., Mechanical properties of Zylon/epoxy composite, Composites Part B: engineering 2002, 33: 109-115.

* cited by examiner

MULTI-LAYER STRUCTURE FOR BALLISTIC PROTECTION

CROSS REFERENCE TO RELATED APPLICATIONS

The present application is the US national stage of International Patent Application PCT/IT2011/000295 filed on Aug. 11, 2011.

FIELD OF TECHNOLOGY

The present invention relates to a structure for making ballistic protections, in particular a multi-layer structure combining rigid and flexible elements.

BACKGROUND

Textile flexible structures are known to stop bullet fired by a gun; they are mainly composed of high tenacity fibers arranged in different styles as warp/weft fabric, unidirectional fabric, multiaxial fabric etc.

These types of protections, also known as body armor, are mainly used by Local Police Officers.

Textile flexible structures are not suitable to stop bullet fired from rifle; in this case the protection can only be given by hard plates.

It has been found that a defined combination of soft and rigid textile structures is suitable to stop also bullets fired by a rifle. Ceramic layer can be added to the combination if it is needed to protect from very aggressive Armor Piercing bullets.

These bullets can be used only during war or battle field.

It is known that a good protection has to combine two properties: the possibility of stopping the bullet and the capability of reducing as much as possible the back face deformation.

It is obvious that back face is a critical value when the bullet proof structure protects a person.

High values of the back face deformation can induce necrosis and even fatal injuries; more particularly, high values of back face deformation do not allow the wearer to promptly react to the attack due to the high shock absorbed by the human body.

Patent Application IT MI2009A001222 discloses a structure comprising at least one first and one second textile rigid elements, which are distinct and co-operate with each other to dissipate the energy associated with an incident bullet impact.

The structure above, while providing a good general protection, still needs some improvements in term of trauma reduction.

OBJECTS OF THE DISCLOSURE

It is an object of the present disclosure to overcome at least some of the problems associated with the prior art.

SUMMARY

The present disclosure provides a method and system as set out in the following claims.

According to one aspect of the present disclosure there is provided a ballistic protection, including a rigid structure and a flexible structure, co-operating to dissipate energy associated to an incident bullet impact, the rigid structure and the flexible structure being separated by a at least a first discontinuity layer, the rigid structure including: at least a first rigid layer; at least a second rigid layer; and at least a third layer (105) interposed between the first and the second rigid layer; wherein the material of the first discontinuity layer (109) and of the third layer of the rigid structure (105) are selected so that the speed of propagation of a sound wave through the first discontinuity layer (109) and the third layer of the rigid structure (105) is less than 50% of the speed of propagation of a sound wave through the fibers included in the first rigid layer.

Advantageously, the rigid structure is placed on the side facing the direction of the incident bullet.

In a preferred embodiment of the present invention the first rigid layer is a textile element which includes one or more of the following: UHMWPE (also in the form of strips), aramidic, copolyaramidic, polybenzoossazole, polybenzothiazole, liquid crystal, rigid rood fibers; while the second rigid layer is a textile element including one of the following: UHMWPE (also in the form of strips), aramidic, copolyaramidic, polybenzoossazole, polybenzothiazole, liquid crystal, rigid rod, glass, carbon fibers or a mixture thereof. The textile elements can be totally or partially impregnated by one or more of the following: thermoplastic, thermosetting, elastomeric, viscous or viscoelastic polymers. The textile elements of the first and second rigid layers are laminate elements.

According to possible embodiments of the present invention, the fibers of said first and second textile elements can be either parallel to the fiber of the second textile element or can be oriented with an angle comprised 0° and 90° (e.g. 45°). Combination of textiles layers based on yarn of different mechanical characteristic gives particularly advantageous results The present invention allows to realize a ballistic protection structure with higher stopping power with consistent reduction of the back face deformation.

In another aspect of the present invention, the third element of the rigid structure includes a first and a second part, the first part being fixed to the first rigid layer and the second part being fixed to the second rigid layer, the first and the second parts being reversibly detachable by means of separable fastening means. The first and the second parts can be for example the two members of a Velcro fastening device, wherein one of the two parts is a Velcro hooks member and the other of the two parts is a Velcro loop member.

In a further aspect of the present invention, the third element of the rigid structure and the first discontinuity layer, are made of a material selected from the group consisting of: metallic or plastic laminates, composites, rubber, felts, plastomeric or elastomeric or thermosetting foams, metallic foams, honeycomb structures, fiber based honeycomb or mixtures thereof, having a thickness between 0.05 mm and 15 mm.

In an additional embodiment the third element of the rigid structure does not cover the whole surface of corresponding to the first rigid layer. As a particular case it has a shape substantially of a frame, with an empty area in the middle, so that the structure is particularly reinforced along the edges. In an alternative embodiment, the empty area in the middle of the third element can be filled with e.g. powders or alternatively with the same material indicated for the discontinuity layers above.

The flexible structure can include flexible antiballistic fabrics or flexible antiballistic laminates totally or partially impregnated by one or more of the following: thermoplastic, thermosetting, elastomeric, viscous or viscoelastic polymers Moreover, the structure includes advantageously also one or more ceramic elements situated at the front of said textile elements. This ceramic element can be realized, for example, with carbide oxides or nitrides (for example alumina, boron carbide, silicon carbide, boron nitride and silicon nitride) based ceramics. The ceramic element is advantageously embedded in a polymeric structure that can include reinforcing fibers like carbon, aramid or glass. A discontinuity layer can be placed between the ceramic element and the rigid structure; alternatively the ceramic element can be in direct contact with the rigid structure Combination of the textile layers obtained with yarns having different mechanical characteristics, in particular different tensile strength, gives particularly advantageous results.

The present invention makes it possible to obtain a ballistic protection element, which is particularly effective for bullets fired from a gun as well as for bullets fired from a rifle. In particular the ballistic protection realized with the structure according to a particular embodiment of the present invention provides increased protection along the borders which is where the protection is normally weaker.

Furthermore, a protective element according to the invention attains a trauma reduction without compromising the incident bullets stop capability and, at the same time, allows the protection weight and cost to be reduced.

BRIEF DESCRIPTION OF THE DRAWINGS

These and other advantages, objects and characteristics of the present invention will be better understood by those skilled in the art from the following description and from the enclosed drawings, with reference to non-limiting typical embodiments of the invention described by way of illustrative examples, and therefore not to be considered limiting of its scope, in which.

DETAILED DESCRIPTION OF PREFERRED EMBODIMENTS

Figure 1:
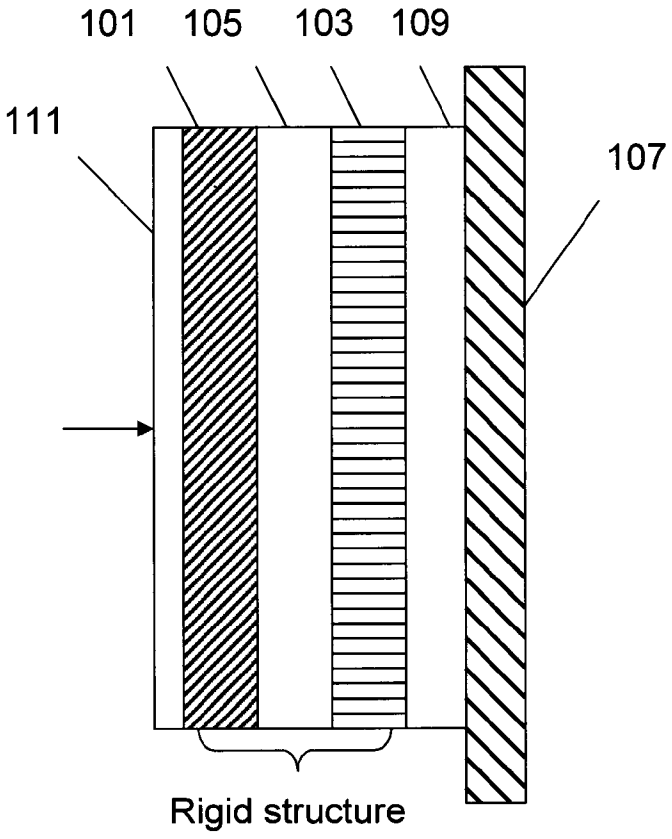
FIG. 1 is a schematic, vertical section view of a structure for making ballistic protections according to a possible embodiment of the present invention.

Reduced to its essential form and with reference to the figures of the enclosed drawings, a ballistic protection according to the present invention includes a rigid structure (101, 103, 105) and a flexible structure 107 which are separated by a discontinuity layer 109. Advantageously, the rigid structure is placed in front of the flexible structure, on the side facing the attack with respect to the direction of the incident bullet.

The rigid structure includes at least three layers. A first rigid layer 101 is a textile element adapted for of deforming an incident bullet and adsorbing part of the energy associated to the bullet impact: such first textile rigid layer preferably includes polyethylene fibers, in particular UHMW polyethylene fibers, such as fibers of the Dyneema® or Spectra® type. A second rigid layer 103 that adsorbs at least part of the residual energy of the deformed bullet is a textile element including one of the following fibers: aramidic (e.g. Kevlar®, Twaron®, Heracon®), copoly aramidic (e.g. Armos®, Rusar®, SVM®, Artec®), UHMW polyethylene, liquid crystal (e.g. Vectran®), rigid rod as M5, polybenzobisoxazole (e.g. Zylon®) or a mixture thereof.

The two textile elements 101 and 103 according to the present embodiment are not in direct contact with each other: a third layer 105 is interposed between the two textile elements. This discontinuity layer has the characteristics that its material is selected so that the layer offers a higher resistance to the propagation of a sound wave induced by the bullet, compared to the resistance to the propagation of shock waves in the first and second rigid layers.

The adsorption of energy by the first ballistic structure which is impacted by the bullet is obtained in part by the breakage of some fibers and in part by the plasto-elastic deformation of the fibers included in the structure.

The speed of adsorption of the energy depends on the speed of transmission in the fibers; such speed is the speed of propagation of the sound wave in the fibers and can be calculated with the following formula:

$$V=\sqrt{E/\delta}$$

(speed V is the square root of the ratio between elastic modulus E and fiber density δ)

The higher the speed of propagation of sound of the fiber, the higher the length of fiber and the quantity of fibers which can adsorb the energy in the time unit.

In other words, a fiber with a high speed of propagation of sound is a better ballistic fiber.

The transfer of energy from the first to the adjacent ballistic structures is realized by means of a shock wave. If we interpose between a first and a second rigid element a third layer which offers a higher resistance to the propagation of a sound wave the ballistic properties of the whole structure are improved. In particular the repeated combination of elements showing a high speed of transmission of the sound wave with elements showing a reduced speed of transmission of the sound wave significantly increases the ballistic properties of the whole ballistic structure.

The first rigid textile element 101 can be realized with yarns having tensile strength higher than or equal to 10 g/den, elongation higher than 1% and modulus higher than 40 GPa. Such first rigid textile rigid element preferably includes polyethylene fibers, in particular UHMW polyethylene fibers, such as fibers of the Dyneema® or Spectra® type. The fibers are preferably impregnated with elastomeric resins, e.g. Kraton® and then laminated to realize a continuous sheet with unidirectional structure, cross plied at 0°/90°.

Several layers of such structure are then superimposed, also cross plied and pressed with a pressure between 20 and 250 Bar at a temperature of about between 110° and 135°. The resulting product is a monolithic element having a weight typically comprised between 5 and 100 kg/m$^2$. The element produced with the process here described can be flat or shaped.

The second rigid textile element 103 can be obtained with yarns having tensile strength higher than or equal to 10 g/den elongation higher than 1% and modulus higher than 40 GPa. In a preferred embodiment, the second rigid textile layer aramidic, copolyaramidic, P.B.O., liquid crystal polymers, solid rod polymers, glass, asbestos, carbon, polyvinilalcool, polypropylene, UHMWPE and mixture thereof in form of yarn or tapes.

The structure of the second rigid textile element comprises warp and weft, unidirectional, semi-unidirectional, biaxial, multi-axial, tridimensional textile structures. These textiles structures are generally impregnated at least partially for example by one of the following: thermoplastic, thermosetting, elastomeric, viscous or viscoelastic resin. Examples of these structures are known as "Goldshield®, Spectrashield®, LFT21®, Kevlar XP®.

In a preferred embodiment the sound of speed in fiber or tapes of the second rigid element is at least 10% lower compared to the sound speed of the fibers of the first rigid element.

The weight of the second rigid element is between 5% and 65% when compared to the weight of first rigid element.

The fibers of the first rigid textile element 101 can be either parallel to the fibers of the second rigid textile element 103, or oriented at an angle between 0° and 90° with respect thereto (for example, at 45°).

Between the first and the second rigid element (101 and 103) a discontinuity layer 105 is provided. The discontinuity layer can be made of many different materials and have many different shapes. For example it can be a metal rigid layer (e.g. aluminum, titanium, steel) or can be in form of composite like for example glass, carbon, asbestos, impregnated with thermoplastic or thermosetting resins, polymeric rigid material like nylon, polycarbonate, rigid or soft foams, felts, fabrics woven not woven, honey combs, rubber.

To reach the purpose of the present invention the third layer of the rigid structure is selected so that the layer offers a higher resistance to the propagation of the shockwave. The speed of sound in this third element must be less than 50% compared to the speed of sound through the fibers of the first and second rigid structure.

The thickness of such layer is comprised between 0.05 mm and 15 m.

In one preferred embodiment the thickness is comprised between 1 mm and 6 mm.

Figure 2:
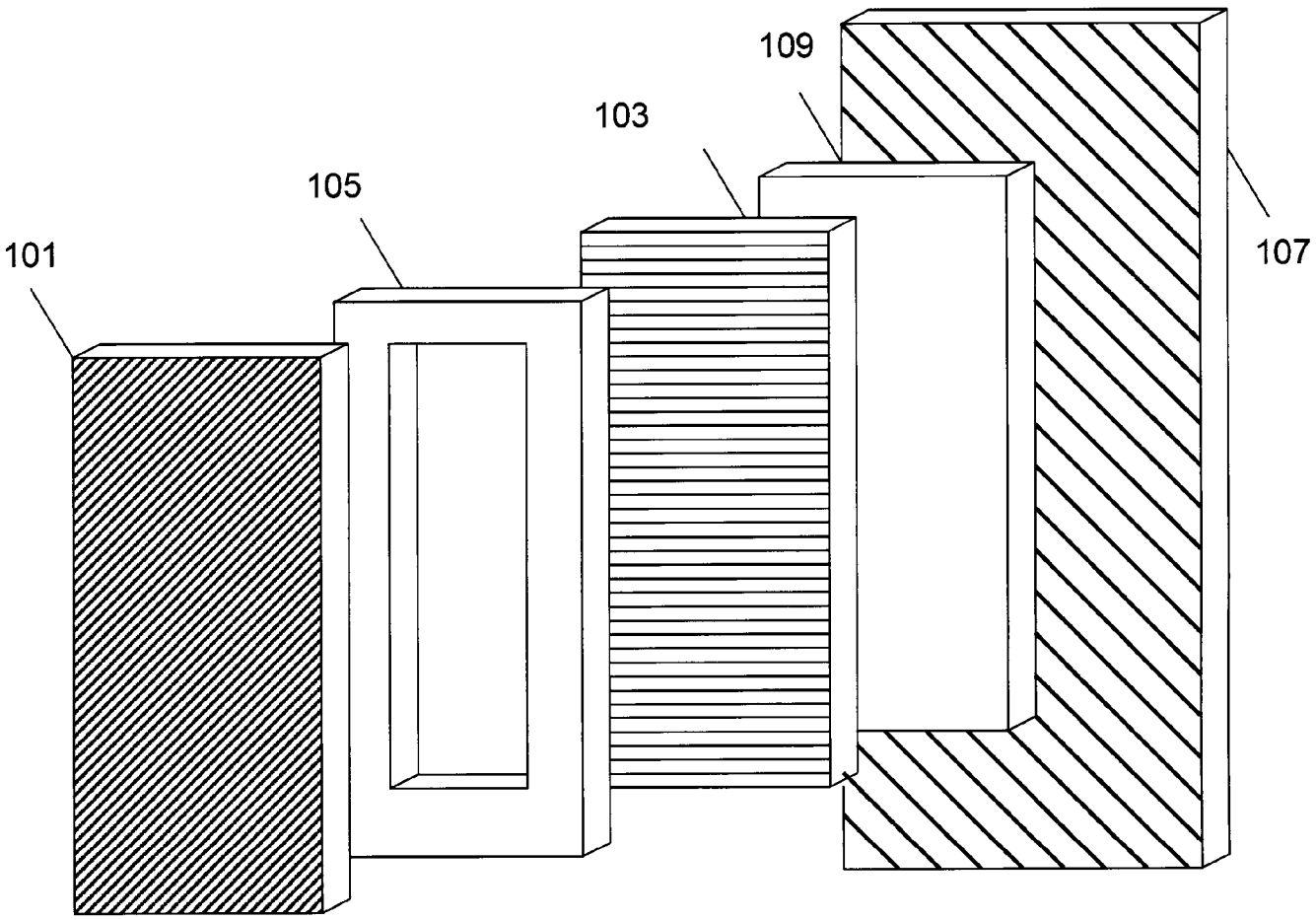
FIG. 2 is a schematic exploded view of the structure of FIG. 1.

In an alternative embodiment the layer 105 covers only a portion of the surface of the two rigid elements (101, 103) where the surface not covered by the layer 105 is at least 5%. In a preferred embodiment the layer 105 has substantially the shape of a frame as shown in FIG. 2. In this way the protection along the edges is increased. This solves one of the drawbacks of the prior art ballistic protections. Next to the edges the protection against bullets provided by ballistic protections is normally lower. The particular shape of the third layer according to an embodiment of the present invention gives a substantial contribution in increasing the ballistic performances along the edges, without excessively increasing the total weight of the protection. The area in the middle can be left empty (i.e. filled with air) or alternatively the space could be filled with several materials, e.g. powders, expanded glass balls, corrugated sheets, foams and any other already described for the first discontinuity layer 109 and the third layer of the rigid structure 105.

According to an embodiment of the present invention, the third layer is made of two parts each one attached to one of the first and second rigid element. The two parts are arranged to engage one each other in order to be reversibly fastened/unfastened. As an example they can be the two members of a Velcro® fastening device one being the Velcro® hooks member, the other being the Velcro® loops member. The two parts hooks and loops can cover only a portion of the surface of the rigid structure as explained above.

The flexible structure 107 in a preferred embodiment of the present invention is represented by unidirectional, semi-unidirectional biaxial, multiaxial or woven fabrics also in blend thereof structures. These structures can be not impregnated, partially impregnated, totally impregnated or stitched together.

The impregnation is realized with: thermoplastic, thermosetting, elastomeric, viscous or viscoelastic polymers or mixture thereof.

The count of the fibers is comprised between 50 and 10.000 denier preferably between 290 and 3300 den.

Advantageously, the mechanical characteristics of the fibers of the flexible structure 107 are the following: tensile strength higher than or equal to 20 g/den, elongation greater than 1%, a modulus higher than 50 GPa The discontinuity layer 109 placed between the rigid structure (101, 103 and 105) and the flexible structure 107 is made of a material having the same characteristics as the third layer of the rigid structure 105 described above.

In a alternative embodiment, requiring an increased protection against perforation from armour-piercing bullets, in particular bullets of penetrating type (e.g. 7.62×51AP), one or more ceramic or glass-ceramic elements 111 can be associated to the above described structure (not shown in FIG. 2).

Said ceramic elements 111, which can be realized, for example, from carbide oxides or nitrides based ceramics, can be monolithic or made of juxtaposed ceramic sub-elements. In a preferred embodiment of the present invention the at least one ceramic element is embedded in a polymeric structure.

Such ceramic elements can be in direct contacts with the first rigid structure or separated by a discontinuity layer (not shown neither in FIG. 1 nor in FIG. 2) similar to that already described for the first discontinuity layer 109 and the third layer of the rigid structure 105.

The ceramic element is generally protected by an additional structure in order to avoid as much as possible fragmentation of the element being the ceramic very hard but also very fragile.

The protection is composed of a fabric embedded in rigid matrices for example a composite layer. The fabric comprises for example carbon, glass, asbestos, aramidic. This technology is well known to the person skilled on the art.

Further combinations are possible depending on the desired combination of back face deformation and stopping power.

E.g. in the illustrated examples of the present invention reference has be made to a rigid structure including two textile elements (101, 103) and a discontinuity layer (105) between the two textile elements.

However it is possible to include plurality of "packages" composed by two textile elements (101, 103) and the discontinuity layer 105 and an additional separating layer with the same characteristics described above for the discontinuity layer 105.

In any case it is possible to include more than one flexible structure 107 or additional discontinuity layers 109.

In practice, in any case, the realization details can vary in a corresponding way as for single constructive elements described and illustrated and as for the indicated materials nature without departing the adopted solution concept and consequently, remaining within the scope of the present invention.

It will be appreciated that alterations and modifications may be made to the above without departing from the scope of the disclosure. Naturally, in order to satisfy specific requirements, a person skilled in the art may apply to the solution described above many modifications and alterations. Particularly, although the present disclosure has been described with a certain degree of accuracy with reference to preferred embodiment(s) thereof, it should be understood that possible omissions, substitutions and changes in the form and details as well as other embodiments are possible; moreover, it is expressly intended that specific elements and/or method steps described in connection with any disclosed embodiment of the disclosure may be incorporated in any other embodiment as a general matter of design choice.

For example, similar considerations apply if the components have different structure or include equivalent units.

The invention claimed is:

1. A ballistic protection, including at least one rigid ballistic structure and at least one flexible ballistic structure, cooperating to dissipate energy associated to an incident bullet impact, the at least one rigid ballistic structure and the at least one flexible ballistic structure being separated by at least a first discontinuity layer including elements made of a material selected from the group of: rigid or flexible plastomeric foams, elastomeric foams, viscoelastic foams, paper, woven fabrics, non-woven fabrics, felts, honeycomb structures, elastomeric polymers, plastomeric polymers, viscous polymers, viscoelastic polymers, or mixtures thereof, the at least one ballistic rigid structure including:

at least a first textile rigid layer including one or more of the following: UHMW polyethylene, aramidic, copolyaramidic, polybenzoossazole, polybenzothiazole, liquid crystal, rigid rod fibers;

at least a second textile rigid layer including one or more of the following: UHMW polyethylene, aramidic, copolyaramidic, polybenzoossazole, polybenzothiazole, liquid crystal, rigid rod, glass, carbon fibers; and at least a third layer interposed between the at least first textile rigid layer and the at least second textile rigid layer, wherein the at least third layer of the rigid ballistic structure is an element that covers only a portion of a surface corresponding to the surface of the first textile rigid layer, and wherein the at least third layer of the rigid ballistic structure has a shape substantially of a frame and having a middle portion including elements made of a material selected from the group of: rigid or flexible plastomeric foams, elastomeric foams, viscoelastic foams, paper, woven fabrics, non-woven fabrics, felts, honeycomb structures, elastomeric polymers, plastomeric polymers, viscous polymers, viscoelastic polymers, or mixtures thereof;

wherein the material of the at least first discontinuity layer and of the at least third layer of the rigid ballistic structure are selected so that the speed of propagation of a sound wave through the at least first discontinuity layer and the at least third layer of the rigid ballistic structure is less than 50% of the speed of propagation of a sound wave through the fibers of the first rigid layer.

2. The ballistic protection of claim 1, wherein the at least first and at least second textile rigid elements comprise laminate textile element in form of:

unidirectional, semi-unidirectional, bi-axial, multiaxial, or warp and weft structures.

3. The ballistic protection of claim 2, wherein the textile elements are totally or partially impregnated by one or more of the following: thermoplastic, thermosetting, elastomeric, viscous or viscoelastic polymers.

4. The ballistic protection of claim 1, wherein the at least third layer of the rigid ballistic structure includes a first and a second part, the first part being fixed to the at least first textile rigid layer and the second part being fixed to the at least second textile rigid layer, the first and the second parts being reversibly detachable by means of separable fastening means.

5. The ballistic protection of claim 4, wherein the first and the second parts are the two members of a Velcro fastening device, wherein one of the two parts is a Velcro hooks member and the other of the two parts is a Velcro loops member.

6. The ballistic protection of claim 1, wherein the at least third layer of the rigid ballistic structure includes a metallic element, also in form of metallic foam.

7. The ballistic protection of claim 1, wherein the at least one flexible ballistic structure includes flexible antiballistic fabrics or flexible antiballistic laminates totally or partially impregnated by one or more of the following: thermoplastic, thermosetting, elastomeric, viscous or viscoelastic polymers.

8. The ballistic protection of claim 1, including at least one ceramic element also embedded in a polymeric structure and situated outside and before the at least one rigid ballistic structure and the at least one flexible ballistic structure with respect to the incident bullet direction.

9. The ballistic protection of claim 8, further including a discontinuity layer between the at least one ceramic element and the at least one rigid ballistic structure.

10. A ballistic protective article, including the ballistic protection according to claim 1.

11. The ballistic protection of claim 1, wherein the at least first textile rigid layer includes yarns having a tensile strength at least ten grams per denier, an elongation higher than one percent and modulus higher than forty GPa; and wherein the at least second textile rigid layer includes yarns having a tensile strength at least ten grams per denier, an elongation higher than one percent and modulus higher than forty GPa.

12. The ballistic protection of claim 11, wherein the flexible ballistic structure includes fibers between fifty and ten-thousand denier with a tensile strength at least twenty grams per denier, an elongation greater than one percent and modulus higher than fifty GPa.

13. The ballistic protection of claim 1, wherein the at least third layer of the rigid structure has a thickness between 0.05 mm and fifteen mm.

14. The ballistic protection of claim 13, wherein the at least first textile rigid layer, the at least second textile rigid layer and the at least third layer of the rigid structure are superimposed, cross plied and pressed so as to have a weight between five and one-hundred kilograms per square-meter.

15. An apparatus, comprising:

(1) a rigid ballistic structure having (a) a first layer including a textile material selected from the group consisting of UHMW polyethylene, aramidic, copolyaramidic, polybenzoossazole, polybenzothiazole, liquid crystal and rigid rod fibers;

(b) a second layer including a textile material selected from the group consisting of UHMW polyethylene, aramidic, copolyaramidic, polybenzoossazole, polybenzothiazole, liquid crystal, rigid rod, glass and carbon fibers;

(c) a third layer interposed between the first textile layer and the second textile layer, wherein the third layer of the rigid ballistic structure is an element that covers only a portion of a surface corresponding to the surface of the first textile layer, and wherein the third layer of the rigid ballistic structure has a shape substantially of a frame and having a middle portion including a resistance material selected from the group consisting of rigid plastomeric foams, flexible plastomeric foams, elastomeric foams, viscoelastic foams, paper, woven fabrics, non-woven fabrics, felts, honeycomb structures, elastomeric polymers, plastomeric polymers, viscous polymers, viscoelastic polymers, and mixtures thereof; and (2) a flexible ballistic structure; and (3) a discontinuity layer disposed between the rigid ballistic structure and the flexible ballistic structure, the discontinuity layer including a resistance material selected from the group consisting of rigid plastomeric foams, flexible plastomeric foams, elastomeric foams, viscoelastic foams, paper, woven fabrics, non-woven fabrics, felts, honeycomb structures, elastomeric polymers, plastomeric polymers, viscous polymers, viscoelastic polymers, and mixtures thereof.

16. The ballistic protection of claim 15, wherein the first layer of the rigid structure includes yarns having a tensile strength at least ten grams per denier, an elongation higher than one percent and modulus higher than forty GPa; wherein the second layer of the rigid structure includes yarns having a tensile strength at least ten grams per denier, an elongation higher than one percent and modulus higher than forty GPa; wherein the third layer of the rigid structure has a thickness between one mm and six mm; and wherein the flexible ballistic structure includes fibers between two-hundred-ninety and three-thousand-three-hundred denier with a tensile strength at least twenty grams per denier, an elongation greater than one percent and modulus higher than fifty GPa.

17. The apparatus of claim 16, further comprising a ceramic layer positioned adjacent the rigid ballistic structure and away from the discontinuity layer.

* * * * *